US008137154B2

(12) United States Patent
Sturman et al.

(10) Patent No.: US 8,137,154 B2
(45) Date of Patent: Mar. 20, 2012

(54) BRASSIERE WIRE

(76) Inventors: Richard Sturman, Kirkby-in-Ashfield (GB); Kanwaljit Singh Gill, Nottingham (GB)

( * ) Notice: Subject to any disclaimer, the term of this patent is extended or adjusted under 35 U.S.C. 154(b) by 597 days.

(21) Appl. No.: 11/792,200

(22) PCT Filed: Nov. 23, 2005 (Under 37 CFR 1.47)

(86) PCT No.: PCT/GB2005/004489

§ 371 (c)(1), (2), (4) Date: Sep. 12, 2008

(87) PCT Pub. No.: WO2006/059068

PCT Pub. Date: Jun. 8, 2006

(65) Prior Publication Data

US 2011/0136405 A1 Jun. 9, 2011

(30) Foreign Application Priority Data

Dec. 1, 2004 (GB) ..... 0426321.6

(51) Int. Cl.
*A41C 3/00* (2006.01)

(52) U.S. Cl. ..... 450/41; 450/51; 450/52

(58) Field of Classification Search ..... 450/41, 450/45–47, 51, 52

See application file for complete search history.

(56) References Cited

U.S. PATENT DOCUMENTS

| | | | | |
|---|---|---|---|---|
| 6,241,576 | B1 * | 6/2001 | Hofer | 450/41 |
| 7,128,636 | B1 * | 10/2006 | Marino et al. | 450/41 |
| 7,207,861 | B2 * | 4/2007 | Martini | 450/49 |

FOREIGN PATENT DOCUMENTS

| | | |
|---|---|---|
| GB | 1 170 677 | 11/1969 |
| WO | 03/079831 | 10/2003 |
| WO | 2004/023907 | 3/2004 |

* cited by examiner

*Primary Examiner* — Gloria Hale

(74) *Attorney, Agent, or Firm* — Dickstein Shapiro LLP

(57) ABSTRACT

A brassiere wire molded in one-piece from a plastic material and including a U-shaped body with first and second arms connected by a central body region. The first and second arms include respective terminal ends of the U-shaped body and lie in a common plane with the central body region. The resiliency and rigidity characteristics of the plastic material permit the U-shaped body to distort out of the common plane and cause the central region to torsionally twist about its longitudinal axis when the terminal ends of the arms are flexed toward one another in opposed directions within the common plane. One arm includes a longitudinally extending flexure region spaced in-board from the terminal end of that arm and maintaining axial rigidity along the length of the U-shaped body while enabling an end of that arm to more readily flex in a direction perpendicular to the common plane.

12 Claims, 4 Drawing Sheets

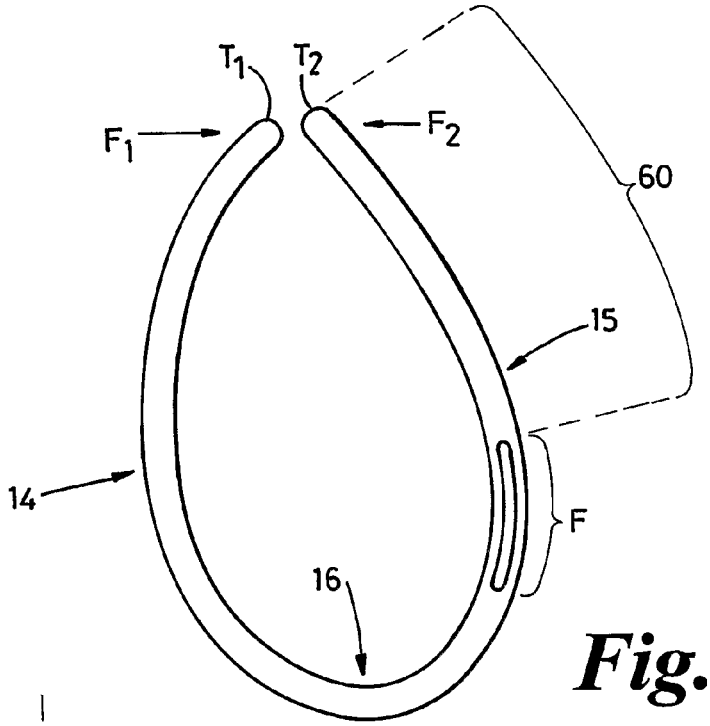
Fig. 4
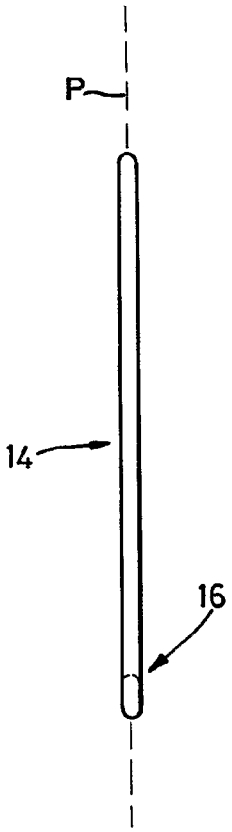
Fig. 5a
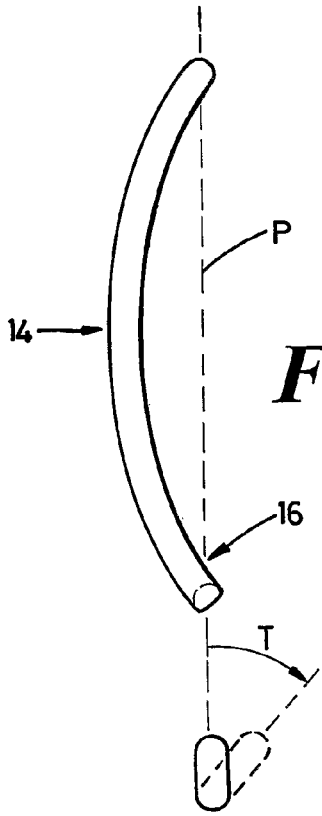
Fig. 5b
Fig. 6

BRASSIERE WIRE

BACKGROUND

The present invention relates to a brassiere wire molded from a plastic material.

It is a general aim of the present invention to provide a plastic brassiere wire which, in wear, provides desirable support for the breasts of the wearer, provides sufficient flexibility for comfort and is able to withstand the rigors of repeated machine washing and tumble drying operations without causing damage to the brassiere in which the brassiere wire is contained or suffering deterioration in its 'in wear' performance.

Although plastic brassiere wires are known they do not satisfactorily achieve the above combination of performance features, i.e. they may exhibit one or more of the above performance features, but not all.

SUMMARY

According to one aspect of the present invention, there is provided a brassiere wire molded in one-piece from a plastic material. The wire comprises a generally U-shaped body defining a first arm and a second arm connected by a central body region, the first and second arms and central body region generally lying in a common plane. The resiliency and rigidity characteristics of the plastic material and the U-shaped body along its length permits the body to distort out of said plane and to cause the central region to torsionally twist about its longitudinal axis when the terminal ends of said first and second arms are flexed toward one another in opposed directions within said plane. The second arm is provided with a longitudinally extending flexure region at its end adjacent to the central body region. The flexure region is spaced in-board from the terminal end of the second arm and is adapted to maintain axial rigidity along the length of the U-shaped body whilst enabling an end of the second arm to more readily flex in a direction perpendicular to said plane.

BRIEF DESCRIPTION OF THE DRAWINGS

Various aspects of the present invention are hereinafter described with reference to the accompanying drawings, in which:—

FIG. 4 is a view similar to FIG. 1 showing the shape adopted by the brassiere wire when opposed ends are pressed inwards as indicated by arrows $F_1$, $F_2$ in FIG. 1;

FIGS. 5*a*, 5*b* are side views of the brassiere wire shown in FIGS. 1 and 4 respectively;

FIG. 6 is a cross-sectional view taken along line VI-VI showing the relative positions of that section in FIGS. 1 and 4.

DETAILED DESCRIPTION

Figure 1:
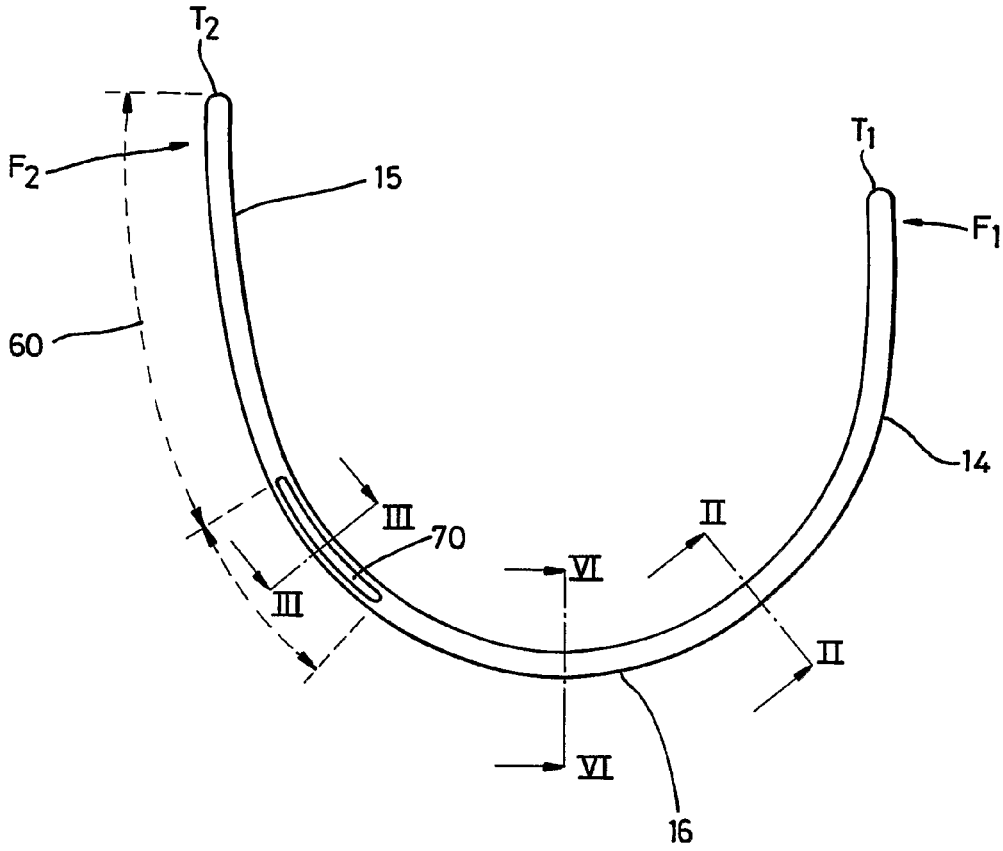
FIG. 1 is a front view of a brassiere wire according to a first embodiment of the present invention.

A brassiere wire 10 according to a preferred embodiment of the invention is illustrated in FIG. 1.

As seen in FIG. 1, the wire 10 is a generally U-shaped body having a pair of opposed arms 14, 15 extending from a central zone 16. As seen in FIG. 5*a*, the arms 14, 15 and central zone 16 are preferably co-planar, i.e. the U-shaped body lies in a plane P. In use, the wire 10 is fitted within a brassiere in a conventional manner (i.e. it is received within a tube extending around the lower periphery of a breast cup) and it is intended that arm 14 will be located in the brassiere so as to lie inbetween the breast pockets and arm 15 will be located on the outer region of each breast pocket. Accordingly, in wear, the arm 15 will extend upwardly towards the armpit of the wearer. Preferably, arm 15 is longer than arm 14.

Figure 2A:
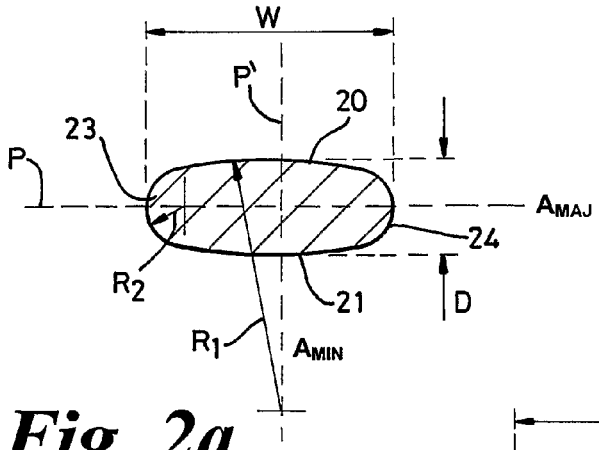
FIGS. 2*a*, 2*b*, 2*c* are sectional views taken along line II-II in FIG. 1 according to respective embodiments of the present invention.
Figure 2B:
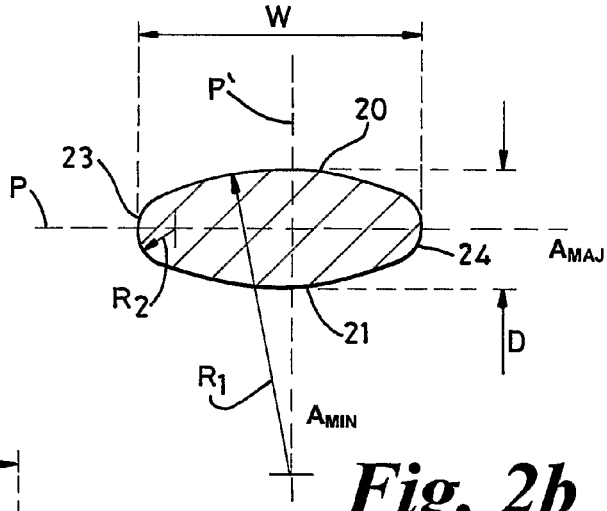
Figure 2C:
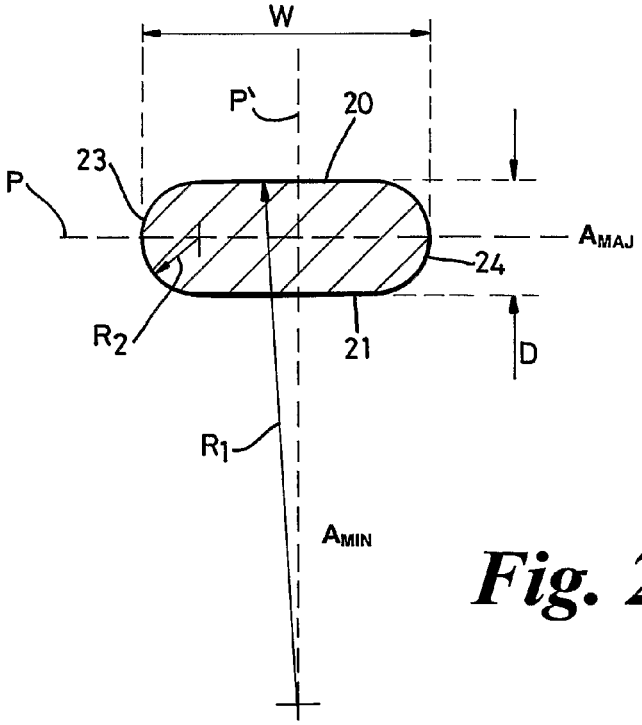

As seen in FIGS. 2*a*, 2*b* and 2*c*, the wire 10 has a cross-sectional shape which has a width W greater than its depth D. Except for a flexure region F (described below), the cross-sectional shape and size of the wire is preferably constant along its entire length.

Accordingly, since the cross-section of the body has a greater width W than depth D the sectional shape can be considered to have a major axis $A_{MAJ}$ and a minor axis $A_{MIN}$; the major axis $A_{MAJ}$ being located within plane P and the minor axis $A_{MIN}$ being located 90° to plane P in a plane P'.

In view of this, the U-shaped body exhibits a greater resistance against flexure in directions within plane P than in plane P'. In this specification, the resistance to flexure in directions within plane P is referred to as the 'axial rigidity' of the U-shaped body.

Preferably, as seen in FIGS. 2*a*, 2*b*, 2*c*, the top and bottom faces 20, 21 of the wire and its opposed side faces 23, 24 are all rounded such that the cross-sectional shape is generally ovoid.

Preferably the cross-sectional shape of the wire is symmetrical about both its major axis $A_{MAJ}$ and its minor axis $A_{MIN}$. Accordingly, the cross-sectional shape has a maximum depth value D at the location of the minor axis $A_{MIN}$ and the depth value decreases towards the respective opposed side faces 23, 24.

As indicated in FIG. 4, by suitable choice of plastic material having a desired resiliency, the U-shaped body is capable of being distorted to a collapsed condition whereat the terminal ends $T_1$, $T_2$ of opposed arms 14, 15 are located adjacent to one another by application of opposed forces in the direction of arrows $F_1$, $F_2$ applied within plane P at the terminal ends $T_1$, $T_2$.

In addition to the application of forces $F_1$, $F_2$ causing distortion within plane P of the U-shaped body as shown in FIG. 4, by adopting a suitable cross-sectional shape and size along the length of the U-shaped body, it is also distorted out of the plane P as shown in FIG. 5*b*. The distortion out of plane P results in a twisting motion T (FIG. 6) occurring about the longitudinal axis of the body. In other words, the resiliency and rigidity characteristics of the plastic material and the cross-sectional shape of the U-shaped body along its length are such as to cause the body to distort out of plane P and to cause the central region to torsionally twist about its longitudinal axis when the terminal ends $T_1$, $T_2$ of the first and second arms 14, 15 are flexed toward one another in opposed directions within the plane P.

The twisting motion is greatest in the region of the central zone 16 and reduces towards terminal ends $T_1$, $T_2$. This twisting motion also results in the arms 14, 15 assuming a curved shape extending out of the plane P.

It will therefore be appreciated that resistance to forces $F_1$, $F_2$ is generated by the axial rigidity of the body and by torsional resistance of the body.

During washing and tumble drying operations, it can be expected that the terminal ends $T_1$, $T_2$ of the bra wire 10 will be exposed to high forces $F_1$ and $F_2$. Since the bra wire 10 of the present invention is able, in effect, to collapse to assume the condition as illustrated in FIGS. 4, 5*b*, the bra wire is able to withstand these forces and then resiliently recover to its original shape under the bias generated by flexure against its axial rigidity and under the effect of torsional forces generated by twisting of the body about its longitudinal axis. Accordingly the bra wire 10 is better able to withstand machine washing and tumble drying operations without being permanently distorted. Also 'poke through' of the brassiere garment is less likely since the tips $T_1$, $T_2$ readily move when exposed to forces $F_1$, $F_2$ i.e. poke through is more likely to happen if the tips $T_1$, $T_2$ are absolutely rigid as they would then act as an anvil against which the fabric of the garment would be trapped during application of forces $F_1$ or $F_2$.

In accordance with the preferred embodiment of the invention, the U-shaped body has a cross-sectional shape extending along its entire length which is capable of ensuring that the torsional resistance described above is generated and results in the U-shaped body being distorted out of the plane P. In addition, the cross-sectional shape is also chosen to have relative dimensions in the major and minor axial directions which provide the desired amount of axial rigidity within plane P.

Preferably, the cross-sectional shape has a width dimension in the major axis direction ranging between 2.0 to 10.0 mm and a height dimension in the minor axis ranging between 0.75 to 4.0 mm.

As illustrated in FIGS. 2*a*, 2*b*, 2*c*, the cross-sectional shape is preferably ovoid and this shape is preferably defined by curved top and bottom faces 20, 21 each having a radius of curvature $R_1$ centered on the minor axis $A_{MIN}$ and curved opposed side faces 23, 24 each having a radius of curvature $R_2$ centered on the major axis $A_{MAJ}$.

For a cross-sectional shape having a width dimension in the major axis $A_{MAJ}$ of 2.0 mm and a height dimension in the minor axis $A_{MIN}$ of 0.75 mm (as shown in FIG. 2*a*), $R_1$ is selected to be in the range 3.4 to 3.8 mm, and most preferably about 3.6 mm; and $R_2$ is selected to be in the range of 0.1 to 0.5 mm, and most preferably about 0.3 mm.

For a cross-sectional shape having a width dimension in the major axis $A_{MAJ}$ of 10.0 mm and a height dimension in the minor axis $A_{MIN}$ of 4M mm (as shown in FIGS. 2*b*, 2*c*), $R_1$ is selected to be in the range 10 to 100 mm, and more preferably in the range 11 to 95 mm; and $R_2$ is selected to be in the range 1.0 to 2.0 mm, and more preferably in the range 1.25 to 1.95 mm.

In wear, it is desirable for the U-shaped body defining the bra wire 10 to be sufficiently flexible to bend out of the plane P in order to follow the curve of the wearer's rib cage. This curve is shallow for the region between and beneath the breasts but becomes more pronounced and deeper at the lower outside region of the breasts. From this lower outside region, the bra wire 10 extends towards the armpit of the wearer and again the curve becomes shallow.

In order to provide the bra wire 10 with the ability to more readily flex at the lower outer region of the breast and so accommodate the more pronounced and deeper curve of the wearer's rib cage at this point, the U-shaped body is provided with a flexure region F. The flexure region F is adapted to enable the end region 60 of arm 15 to flex out of plane P but is also adapted to maintain the axial rigidity of the U-shaped body such that application of forces $F_1$, $F_2$ cause the twisting motions described above (i.e. the U-shaped body, on application of forces $F_1$, $F_2$ is able to assume the modes as illustrated in FIGS. 4 and 5*b*). In addition, maintenance of the axial rigidity along the length of the U-shaped body ensures that the bra wire 10 acts to provide support for the breasts in wear throughout the entire length of the bra wire.

Preferably, flexure region F is defined by the provision of one or more longitudinally extending grooves 70 formed in the U-shaped body at the end of the second arm 15 adjacent to the central body portion 16. The provision of grooves 70 removes material from the section of the U-shaped body, i.e. they provide thinner regions in the minor axis $A_{MIN}$ direction and so enable the U-shaped body to flex more easily out of the plane P. The grooves 70 also define longitudinally extending ribs 71 which act to preserve the axial rigidity of the U-shaped body throughout the flexure region F.

Preferably, a groove 70 is provided on both faces 20, 21 although it is envisaged that one or more grooves 70 may be provided on one face 20 or 21 only.

Preferably, the flexure region extends axially along the U-shaped body for a distance in the range of 5.0 to 100.0 mm.

Figure 3A:
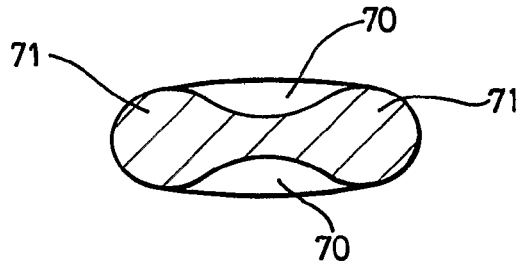
FIGS. 3*a*, 3*b*, 3*c* are sectional views taken along line in FIG. 1 according to the corresponding embodiments shown in FIGS. 2*a*, 2*b*, 2*c;*
Figure 3B:
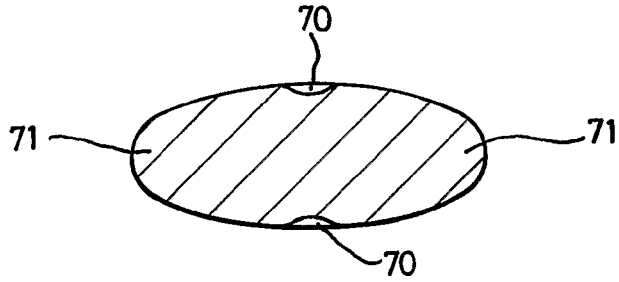
Figure 3C:
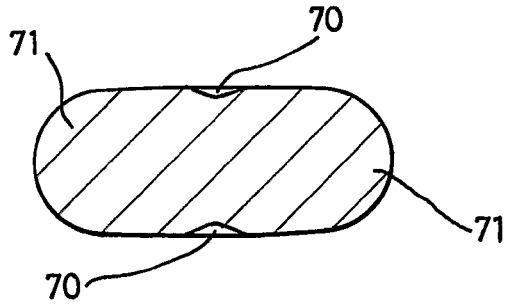

Preferably, when two opposed grooves 70 are provided as shown in FIGS. 3*a*, 3*b*, 3*c*, the depth of each groove 70 ranges between 0.5 to 1.75 mm and the width of each groove 70 ranges between 0.5 to 6.0 mm.

Preferably, the axial extent of the end portion 60 of arm 15 which extends from the flexure region to tip $T_2$ is in the range of 10.0 to 150.0 mm.

Preferably, the U-shaped body is molded in one piece, preferably by injection molding, from a suitable plastic material. Preferably, the plastic material is an acetal resin which may or may not contain reinforcing filler such as glass. An example of one such suitable acetal resin is one supplied by E.I. du Pont de Nemours and Company under the brand name DELRIN®. An acetal resin is preferably utilized as it provides the desired resiliency at elevated temperatures (such as 100° C.) to ensure that the shape of the bra wire 10 is retained.

Other suitable plastic materials which may be used for molding the bra wire 10 include a thermoplastic polyester, a thermoplastic polyester elastomer, and/or a liquid crystal polymer. Examples of such suitable plastic materials may be sold under the trademarks VECTRA®, CELANEX® and RITEFLEX® by a company called Ticona.

The invention claimed is:

1. A brassiere wire molded in one-piece from a plastic material, the wire comprising a U shaped body including a first arm and a second arm connected by a central body region, each of the first arm and the second arm including a respective terminal end of the U-shaped body, the first and second arms and the central body region lying in a common plane, the resiliency and rigidity characteristics of the plastic material and the U-shaped body along its length permitting the body to distort out of the common plane and to cause the central region to torsionally twist about a longitudinal axis extending along the length of the U-shaped body when the terminal ends of said first and second arms are flexed toward one another in opposed directions within the common plane, the second arm being provided with a longitudinally extending flexure region at an end adjacent to the central body region, the flexure region being spaced in-board from the terminal end of the second arm and adapted to maintain axial rigidity along the length of the U-shaped body whilst enabling an end of the second arm to more readily flex in a direction perpendicular to the common plane.

2. A brassiere wire according to claim 1 wherein the U-shaped body has a constant cross-sectional shape and size along its length except for the flexure region.

3. A brassiere wire according to claim 2 wherein the cross-sectional shape is ovoid defined by upper and lower opposed faces arranged about a major axis and opposed side faces arranged about a minor axis, the major axis being co-planar or parallel with said plane.

4. A brassiere wire according to claim 3 wherein the upper and lower opposed faces are symmetrically arranged about the major axis and, in section, have a radius of curvature in the range of 3.4 to 100 mm centered on the minor axis.

5. A brassiere wire according to claim 3 wherein the opposed side faces are symmetrically arranged about the minor axis and, in section, have a radius of curvature in the range of 0.1 to 2 mm centered on the major axis.

6. A brassiere wire according to claim 1 wherein the cross-sectional width dimension in said plane of the U-shaped body along its length is in the range of 2.0 to 10.0 mm.

7. A brassiere wire according to claim 6 wherein the cross-sectional height dimension perpendicular to said plane of the U-shaped body along its length is in the range of 0.75 to 4.0 mm.

8. A brassiere wire according to claim 1 wherein an outer end region of the second arm has an axial length in the range of 10.0 to 150.0 mm.

9. A brassiere wire according to claim 1 wherein the flexure region has an axial length in the range of 5.0 to 100.0 mm.

10. A brassiere according to claim 1 wherein the flexure region is defined by one or more longitudinally extending grooves formed in the U-shaped body.

11. A brassiere wire according to claim 1 wherein the plastic material is an acetal resin.

12. A brassiere wire according to claim 1 wherein the U-shaped body is an injection molding.

* * * * *